US010280670B2

(12) United States Patent
Roberts

(10) Patent No.: US 10,280,670 B2
(45) Date of Patent: May 7, 2019

(54) DUAL DIRECTION DOOR CLOSER

(71) Applicant: Yale Security, Inc., Monroe, NC (US)

(72) Inventor: Edgar E. Roberts, Kings Mountain, NC (US)

(73) Assignee: YALE SECUTIRY, INC., Monroe, NC (US)

( * ) Notice: Subject to any disclaimer, the term of this patent is extended or adjusted under 35 U.S.C. 154(b) by 0 days.

(21) Appl. No.: 15/319,266

(22) PCT Filed: Aug. 11, 2016

(86) PCT No.: PCT/US2016/046581
§ 371 (c)(1),
(2) Date: Dec. 15, 2016

(87) PCT Pub. No.: WO2017/030904
PCT Pub. Date: Feb. 23, 2017

(65) Prior Publication Data

US 2018/0148967 A1 May 31, 2018

Related U.S. Application Data

(60) Provisional application No. 62/206,340, filed on Aug. 18, 2015.

(51) Int. Cl.
*E05F 3/00* (2006.01)
*E05F 3/10* (2006.01)
(Continued)

(52) U.S. Cl.
CPC ..... *E05F 3/102* (2013.01); *E05F 1/1025* (2013.01); *E05F 1/14* (2013.01); *E05F 1/1008* (2013.01); *E05Y 2900/132* (2013.01)

(58) Field of Classification Search
CPC . Y10T 16/577; Y10T 16/2804; Y10T 16/285; Y10T 16/293; Y10T 16/585;
(Continued)

(56) References Cited

U.S. PATENT DOCUMENTS 1,323,338 A * 12/1919 Voight ..... E05F 3/02 16/69
1,989,908 A 2/1935 Bohnsack
(Continued)

FOREIGN PATENT DOCUMENTS

GB 413922 7/1934

*Primary Examiner* — Chuck Y Mah
(74) *Attorney, Agent, or Firm* — DeLio, Peterson & Curcio, LLC; David R. Pegnataro

(57) ABSTRACT

A door closer comprises a housing mountable to one of a door or a door frame, an arm having a first end pivotally attached to the housing and a second end connected to the other of the door or door frame, the arm being movable between a neutral door position and first and second open door positions up to 180 degrees from the neutral position in opposite directions, and opposing first and second racks movable relative to each other and relative to the housing. Each of the first and second racks has a first end adapted to engage a piston within the housing. The door closer further comprises a pinion within the housing pivotally connected to the arm first end and engaging teeth of the first and second racks, a piston having a first end adapted to engage the first end of the first and second racks, and a spring compressible by an opposite end of the piston. Movement of the arm from the neutral position to one of the first or second door open positions rotates the pinion and urges the first end of the first or second rack into engagement with the piston first end, the piston compressing the spring until the door reaches one of the first or second door open positions, and movement of the arm from the neutral position to the other of the first or second door open position rotates the pinion in an opposite direction and urges the first end of the other of the first or second rack into engagement with the piston first end, the piston compressing the spring until the door reaches the other of the first or second door open position.

21 Claims, 4 Drawing Sheets

(51) Int. Cl.
*E05F 1/14* (2006.01)
*E05F 1/10* (2006.01)

(58) Field of Classification Search
CPC ..... Y10T 16/299; Y10T 16/286; Y10T 16/27; Y10T 16/2774; Y10T 16/2777; Y10T 16/56; Y10T 16/552; E05F 3/12; E05F 3/104; E05F 3/102; E05F 3/22; E05F 3/221; E05F 3/223; E05F 3/225; E05F 3/227; E05F 1/1025; E05F 1/04; E05F 1/1041; E05F 1/1008; E05Y 2900/132; E05Y 2201/618; E05Y 2201/716; E05Y 2201/722
See application file for complete search history.

(56) References Cited

U.S. PATENT DOCUMENTS 2,471,707 A * 5/1949 Van Veen ..... E05F 3/102 16/62
3,040,717 A * 6/1962 Rumsey ..... F15B 15/065 74/109
3,056,573 A * 10/1962 Matheson ..... F15B 15/065 251/250
3,447,423 A * 6/1969 Henry ..... F15B 15/065 91/26
3,624,864 A * 12/1971 Marr ..... E05F 3/102 119/716
3,699,717 A * 10/1972 Hedrick ..... E05F 15/53 49/137
3,909,876 A 10/1975 Zunkel
4,086,681 A 5/1978 Nakanishi
4,115,897 A 9/1978 Zunkel
4,287,639 A 9/1981 Denton
4,386,446 A * 6/1983 Zunkel ..... E05F 3/12 16/58
4,502,180 A * 3/1985 Harrison ..... E05F 3/102 16/52
4,514,878 A 5/1985 Arneberg
5,187,835 A * 2/1993 Lee ..... E05F 3/102 16/52
5,502,874 A 4/1996 Lucas
5,636,476 A 6/1997 Eikmeier
5,943,736 A 8/1999 Karkkainen
9,051,766 B2 6/2015 Kuan
2006/0021189 A1 2/2006 Johnson
2007/0022664 A1* 2/2007 Mahonen ..... E05F 3/102 49/342
2010/0281650 A1* 11/2010 Kleennann ..... A47L 15/4261 16/64
2014/0157544 A1* 6/2014 Hellwig ..... E05F 3/10 16/72
2015/0322705 A1* 11/2015 Lee ..... E05F 3/102 16/53

* cited by examiner

DUAL DIRECTION DOOR CLOSER

RELATED APPLICATIONS

This application claims the benefit of U.S. Provisional Patent Application No. 62/206,340 filed on Aug. 18, 2015.

BACKGROUND OF THE INVENTION

1. Field of the Invention

A door operator or closer for a door is described and, more particularly, a door operator providing the ability to control the closing of a door which swings in two directions.

2. Description of Related Art

In order to mount conventional door operators or closers, the spring end of the closer body has to be flipped or rotated according to which hand (left or right) the door is mounted, allowing the rack and pinion to travel. This places the adjustment valves either at the bottom or on top of the door closer for adjustments to be made by the end user after it is mounted. Moreover, current door closers require the arm to be rotated a certain degree to get spring tension to close the door completely. All currently designed door closers with single pistons will only allow the door to close in the direction for which it is templated.

To accommodate doors which open in multiple directions, most double action door closers utilize two pistons and multiple sets of adjustment valves for controlling the speed and direction of the door's swing. Both sets of valves require adjustment for controlling the opening and closing of the door in either direction. Moreover, most double action door closers require that the closer arm be pre-tensioned after mounting of the door closer to get spring tension to return the door to the closed position.

Therefore, a need exists for an improved door operator or closer which can control the movement of a door in two directions with a single piston and a single set of valves.

SUMMARY OF THE INVENTION

Bearing in mind the problems and deficiencies of the prior art, it is therefore an object of the present invention to provide an improved door closer which controls the movement of a door in multiple directions.

It is another object of the present invention to provide an improved door closer which controls the movement of a door in multiple directions with a single piston.

A further object of the invention is to provide an improved door closer with a single pinion and dual racks.

It is yet another object of the present invention to provide an improved door closer which controls the movement of a door in multiple directions with a single set of adjustment valves.

It is still yet another object of the present invention to provide an improved door closer which does not require pretension of the arm after mounting the door closer.

Still other objects and advantages of the invention will in part be obvious and will in part be apparent from the specification.

The above and other objects, which will be apparent to those skilled in the art, are achieved in the present invention which is directed to a door closer comprising a housing mountable to one of a door or a door frame, an arm having a first end pivotally attached to the housing and a second end connected to the other of the door or door frame, the arm being movable between a neutral door position and first and second open door positions up to 180 degrees from the neutral position in opposite directions, and opposing first and second racks movable relative to each other and relative to the housing. The first and second racks each have a first end adapted to engage a piston within the housing. The door closer further comprises a pinion within the housing pivotally connected to the arm first end and engaging teeth of the first and second racks, a piston having a first end adapted to engage the first end of the first and second racks, and a spring compressible by an opposite end of the piston. Movement of the arm from the neutral position to one of the first or second door open positions rotates the pinion and urges the first end of the first or second rack into engagement with the piston first end, the piston compressing the spring until the door reaches one of the first or second door open position. Movement of the arm from the neutral position to the other of the first or second door open position rotates the pinion in an opposite direction and urges the first end of the other of the first or second rack into engagement with the piston first end, the piston compressing the spring until the door reaches the other of the first or second door open position.

Each of the first and second racks may be extended in length to allow for the rack and pinion to travel in opposite directions when rotated by movement of the arm between the neutral position and one of the first or second door open positions. In at least one embodiment, the racks may be configured such that when one of the first or second rack first ends engages the piston first end, the other of the first or second rack first ends is not engaged with the piston first end.

The door closer may further comprise a spring-loaded locking mechanism, wherein the locking mechanism engages the piston and one of the first and second racks after movement of the arm from the neutral position to one of the first and second door open positions and disengages from the piston and one of the first and second racks when the arm returns to the neutral position. In an embodiment, the locking mechanism may comprise a projection extending from the piston first end and engaging a concavity in at least one of the first and second rack first ends.

The spring may be biased in partial compression when the arm is in the neutral position, and the door closer may further comprise a set of adjustment valves for controlling the movement of the piston. The set of adjustment valves may face downward when the door closer is mounted to one of the door or door frame.

In another aspect, the present invention is directed to a method of controlling a door. The method comprises providing a door operable between a neutral position and first and second open positions, the first and second open positions up to 180 degrees from the neutral position in opposite directions, and providing a door closer as described above. The method includes initiating movement of the arm from the neutral position to one of the first or second door open positions to rotate the pinion and urge the first end of the first or second rack into engagement with the piston first end, the piston compressing the spring until the door reaches one of the first or second door open position, and returning the arm to the neutral position as a result of the spring urging the piston in an opposite direction against the first or second rack until the spring reaches its initial position.

The door closer may further comprise a spring-loaded locking mechanism, and the method may further include the steps of the locking mechanism engaging the piston and one of the first and second racks after movement of the arm from the neutral position to one of the first and second door open positions and disengaging from the piston and one of the first and second racks when the arm returns to the neutral position. The locking mechanism may comprise a projection extending from the piston first end and engaging a concavity in at least one of the first and second rack first ends.

Each of the first and second racks may be extended in length to allow for the rack and pinion to travel in opposite directions when rotated by movement of the arm between the neutral position and one of the first or second door open positions. In at least one embodiment, the racks may be configured such that when one of the first or second rack first ends engages the piston first end, the other of the first or second rack first ends is not engaged with the piston first end.

In one or more embodiments, the spring may be biased in partial compression when the arm is in the neutral position. The door closer may further comprise a set of adjustment valves for controlling the movement of the piston, and the method may further include the step of adjusting one or more valves corresponding to operating parameters of the door. The set of adjustment valves may face downward when the door closer is mounted to one of the door or door frame.

In still another aspect, the present invention is directed to a method of making a door closer. The method comprises providing a housing mountable to one of a door or a door frame, and providing an arm having a first end pivotally attached to the housing and a second end connected to the other of the door or door frame, the arm being movable between a neutral door position and first and second open door positions up to 180 degrees from the neutral position in opposite directions. The method further comprises providing opposing first and second racks movable relative to each other and relative to the housing, the first and second racks each having a first end adapted to engage a piston within the housing, providing a pinion within the housing pivotally connected to the arm first end and engaging teeth of the first and second racks, and providing a piston having a first end adapted to engage the first end of the first and second racks. The method further comprises providing a spring compressible by an opposite end of the piston, wherein movement of the arm from the neutral position to one of the first or second door open positions rotates the pinion and urges the first end of the first or second rack into engagement with the piston first end, the piston compressing the spring until the door reaches one of the first or second door open position, and wherein movement of the arm from the neutral position to the other of the first or second door open position rotates the pinion in an opposite direction and urges the first end of the other of the first or second rack into engagement with the piston first end, the piston compressing the spring until the door reaches the other of the first or second door open position.

The method may further comprise providing a spring-loaded locking mechanism, wherein the locking mechanism engages the piston and one of the first and second racks after movement of the arm from the neutral position to one of the first and second door open positions and disengages from the piston and one of the first and second racks when the arm returns to the neutral position. The locking mechanism may comprise a projection extending from the piston first end and engaging a concavity in at least one of the first and second rack first ends.

Each of the first and second racks may be extended in length to allow for the rack and pinion to travel in opposite directions when rotated by movement of the arm between the neutral position and one of the first or second door open positions. In at least one embodiment, the racks may be configured such that when one of the first or second rack first ends engages the piston first end, the other of the first or second rack first ends is not engaged with the piston first end.

In one or more embodiments, the spring may be biased in partial compression when the arm is in the neutral position. The method may further comprise providing a set of adjustment valves for controlling the movement of the piston, and the set of adjustment valves may face downward when the door closer is mounted to one of the door or door frame.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
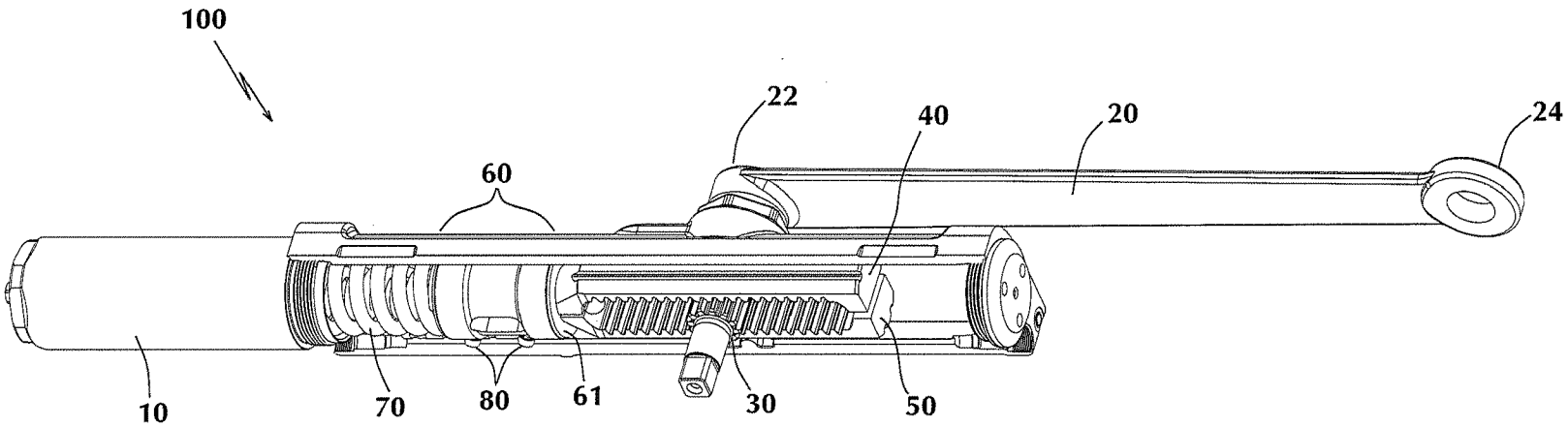
FIG. 1 is a partially cutaway, perspective view of an embodiment of the door closer of the present invention, in the neutral (door closed) position.

In describing the embodiments of the present invention, reference will be made herein to FIGS. 1-5 of the drawings in which like numerals refer to like features of the invention.

Certain terminology is used herein for convenience only and is not to be taken as a limitation on the invention. For example, words such as "upper," "lower," "left," "right," "horizontal," "vertical," "upward," and "downward" merely describe the configuration shown in the FIGS. Indeed, the referenced components may be oriented in any direction and the terminology, therefore, should be understood as encompassing such variations unless specified otherwise. Moreover, the term "exemplary" as used herein may be used to describe one potential embodiment of the present invention, and is not meant to signify that a particular embodiment is the only such embodiment or that the embodiment described is preferable over any other embodiment.

As used herein, the term "open position" for a door means a door position other than a neutral (door closed) position, including any position between the neutral position and a fully-open position as limited only by structure around the door frame, which can be up to 180 degrees from the neutral position.

The present invention is directed to a door operator or closer which can control the movement of a door in multiple directions. In contrast to dual direction door closers of the prior art, wherein the door closer includes two pistons, a rack, a cam or crankshaft, and separate sets of valves controlling each piston, the door operator or closer of the present invention provides for the ability to control the closing of the door in either swing direction (right-handed or left-handed) with a single piston and a pinion with dual opposing racks, and a single set of valves which can control the closing of the door in either direction. The door closer may be used in restaurant kitchen areas and other commercial buildings where its closing capability will allow the control of the door in either direction the door swings.

The dual direction door closer of the present invention works by using a single piston and pinion with dual, opposing racks. In one or more embodiments, the opposing racks' broached teeth may be extended in length to allow the rack and pinion to travel in opposite directions. As the door opens to the left or right, it rotates the pinion, which pushes an active rack against the piston, compressing the spring. In an embodiment, a spring-loaded locking mechanism engages the rack and piston after a few degrees of travel. The rack pushes the piston until the door reaches its full template open position. After which the door spring pushes the door back to its closed position. As the door reaches its closed position, the spring-loaded locking mechanism is disengaged from the piston. When the door is mounted in an environment in which it is allowed to swing in either direction, that is when the rack in the opposite direction will engage the piston. Then the spring-loaded locking mechanism will engage the piston locking it to the opposite rack. The process repeats itself as with the first rack.

Referring now to the drawings, wherein like reference numerals designate corresponding or similar elements throughout the several views, an exemplary door operator or closer according to the present invention is shown in FIG. 1 and generally designated at 100. Door closer 100 may be mounted to either of a door face or a door frame or jamb (not shown). In one embodiment, door closer 100 is mounted to a top door jamb, parallel to the door jamb, with the adjustment valves 80 extending downward. Door closer 100 includes an arm 20 having a first end 22 pivotally connected to the door closer housing 10 and a second end 24 connected to the top of a door (not shown). It should be understood by those skilled in the art that if the door closer 100 was instead mounted to the face of a door, the second end 24 of the door closer arm 20 would be connected to the door frame or door jamb, and the valves 80 would still extend downward. Valves 80 control the movement of the piston 60 (and therefore the movement of the door) in an otherwise conventional manner, and available door controls or operating parameters include the general door closing speed, latch speed, and backcheck.

Figure 4:
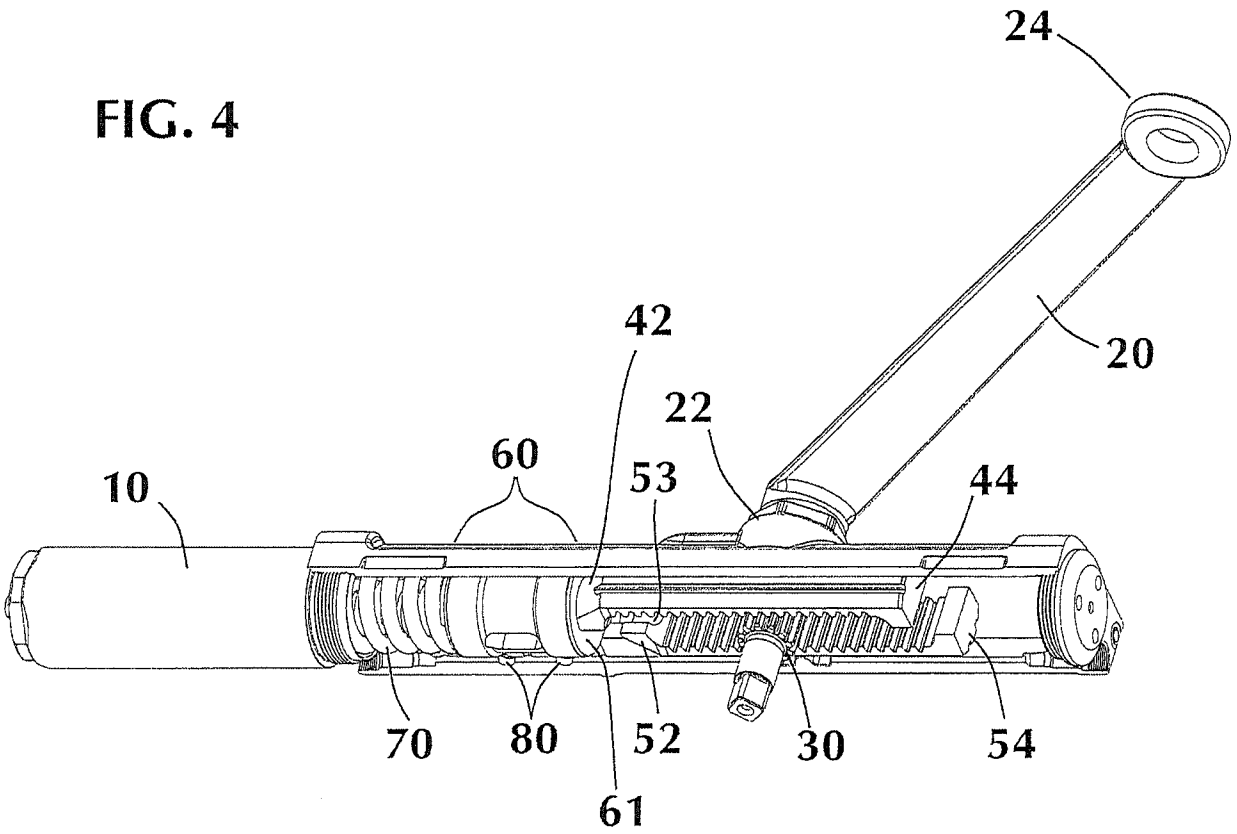
FIG. 4 is a partially cutaway, perspective view of the door closer of FIG. 1, with the door arm in position for a door open in one direction.
Figure 5:
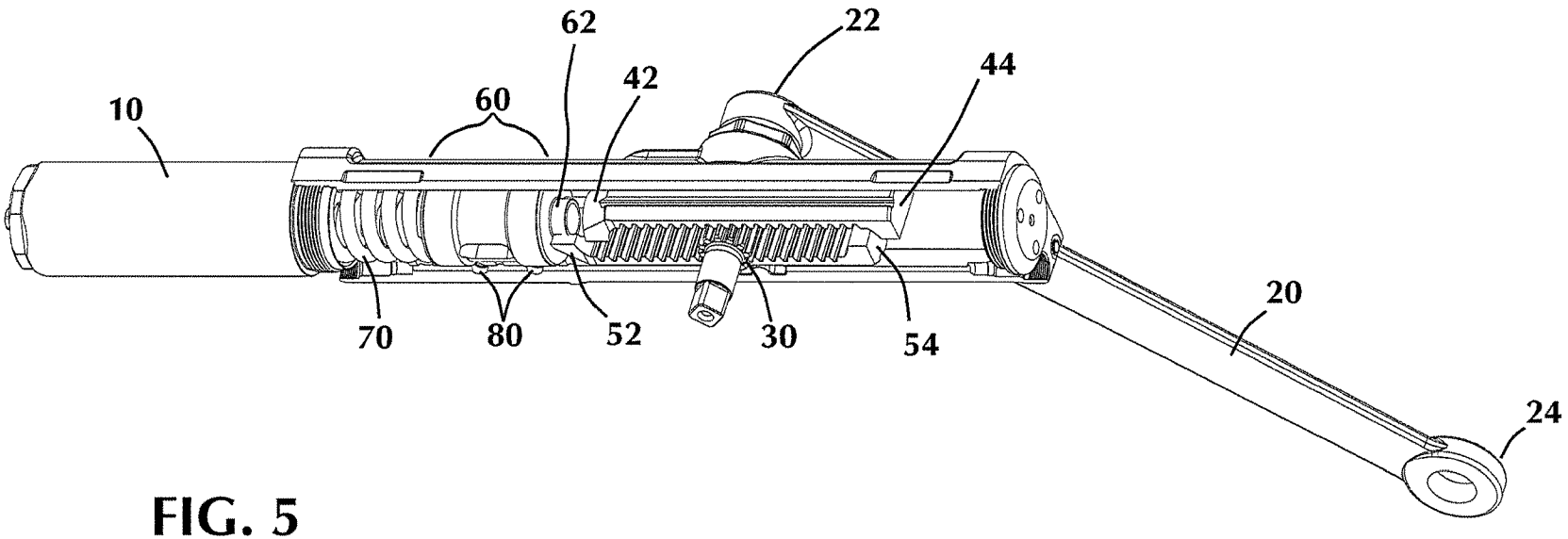
FIG. 5 is a partially cutaway, perspective view of the door closer of FIG. 1, with the door arm in position for a door open in the opposite direction of FIG. 4.

As shown in FIG. 1, arm 20 is in a neutral (door closed) position. Arm 20 is moveable between a neutral position and first and second door open positions (FIGS. 4 and 5). The first and second door open positions may be up to 180 degrees in either direction of the neutral position, as limited only by structure around the door frame, e.g. the door may be capable of swinging up to 180 degrees in either direction.

Figure 2:
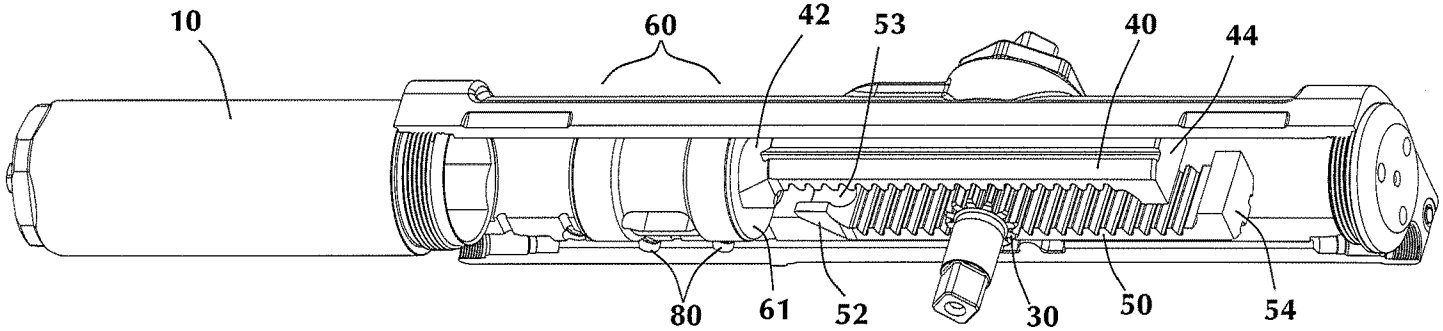
FIG. 2 is a partially cutaway, perspective view of an embodiment of the door closer of the present invention, without the door closer arm and internal spring, showing the dual racks in an open position for a door open in one direction.
Figure 3:
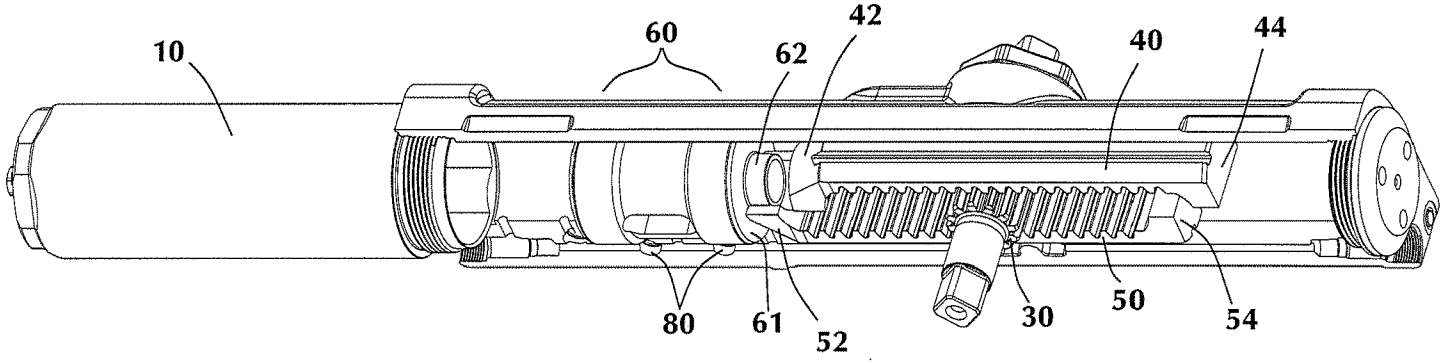
FIG. 3 is a partially cutaway, perspective view of an embodiment of the door closer of the present invention, without the door closer arm and internal spring, showing the dual racks in an open position for a door open in the opposite direction of FIG. 2.

As further shown in FIG. 1, door closer 100 comprises a pinion 30 within the door closer housing 10 which is pivotally connected to the first end 22 of the arm 20. Pinion 30 engages in an otherwise conventional "rack and pinion" manner with the teeth of a pair of opposing racks 40, 50 within housing 10. As shown in FIGS. 2 and 3, racks 40, 50 are movable relative to each other and relative to the housing, and each have a first end 42, 52 adapted to engage a first end 61 of a piston 60 within the door closer housing 10, and a second end 44, 54. In one or more embodiments, the opposing racks' 40, 50 broached teeth may be extended in length to allow the rack and pinion to travel in opposite directions. As shown in FIGS. 4 and 5, and as will be described in further detail below, a spring 70 is compressible by an opposite end of the piston as a result of movement of either the first or second rack 40, 50.

In one or more embodiments, a spring-loaded locking mechanism engages the active rack (based on the desired direction for opening of the door) and piston after a few degrees of travel. The locking mechanism may comprise a projection 62 extending from the first end 61 of the piston 60 which engages a concavity 53 in the first end 42, 52 of the first and second rack (FIGS. 2 and 3). The active rack remains engaged with and pushes the piston until the door reaches its full template open position, after which the spring 70 pushes the door back to its neutral or closed position. As the door reaches the final few degrees of travel to its closed position, the locking mechanism is disengaged from the piston.

Referring now to FIGS. 4 and 5, as the door is opened to the left or right, the arm 20 connected to the door rotates the pinion 30 in an otherwise conventional "rack and pinion" manner, which pushes one of the opposing racks 40, 50 against the piston 60, moving the piston against the spring 70 and further compresses the spring. The active rack 40 or 50 urged against the piston 60 is determined by the direction in which the door is to be opened. In at least one embodiment of the present invention, spring 70 is biased in partial compression when the arm is in the neutral position, eliminating the need to need to pretension the arm after mounting the door closer, as required in door closers of the prior art.

FIG. 4 shows first, active rack 40 moving in the direction of piston 60, the first end 42 sliding the piston 60 toward the spring 70, compressing the spring, as the second rack 50 moves in the opposite direction. FIG. 5 shows second rack 50 moving in the direction toward piston 60, sliding the piston toward spring 70 to compress the spring, while first rack 40 moves in the opposite direction. When arm 20 is moved from the neutral position towards either the first or second (e.g. right or left) open door position, the end 44, 54 of only one rack 40, 50 is engaged with piston 60, as shown in FIGS. 4 and 5. In either direction, the active rack 40, 50 pushes the piston 60 until the door reaches its full open position. Once the door reaches an open position, spring 70 then pushes the piston 60 and corresponding rack in the opposite direction, rotating the pinion 30 until the racks 40, 50 are in the position shown in FIG. 1, indicating that the door is back to its neutral or closed position. As shown in FIG. 1, when the door is in the neutral or closed position, the first ends 42, 52 of both racks 40, 50 are positioned against or engaged with an end 61 of the piston 60.

An advantage of the door operator or closer of the present invention is its ability to control the closing of the door in either direction with a single piston. The control valves of the door closer may always face downward whether mounted on the frame of the door or the door face, and no matter if the door is mounted left-handed, right-handed, or overhead concealed. The fact that the valves may always extend downward is advantageous because it allows for simplified adjustment of the operating parameters of the door by the end user. Moreover, the design of the present invention is such that there is no need to pretension the arm after mounting the door closer because it is under constant spring tension after assembly. Another advantage of the present invention is that unlike other dual direction door closers of the prior art, which have two pistons and a rack, and either a cam or crankshaft with separate sets of valves controlling each piston, the door closer of the present invention provides for the ability to control the closing of the door in either direction using a single set of valves.

Although the door operator or closer has been shown and described in considerable detail with respect to only a few exemplary embodiments thereof, it should be understood by those skilled in the art that it is not intended to limit the invention to the embodiments since various modifications, omissions and additions may be made to the disclosed embodiments without materially departing from the novel teachings and advantages of the controller, particularly in light of the foregoing teachings. Accordingly, it is intended to cover all such modifications, omissions, additions, and equivalents as may be included within the spirit and scope of the description of the controller invention as defined by the following claims. In the claims, means-plus-function clauses are intended to cover the structures described herein as performing the recited function and not only structural equivalents but also equivalent structures. Thus, although a nail and screw may not be structural equivalents, in that a nail employs a cylindrical surface to secure wooden arts together, whereas a screw employs a helical surface, in the environment of fastening wooden parts, a nail and screw may be equivalent structures.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A door closer comprising:

a housing mountable to one of a door or a door frame;

an arm having a first end pivotally attached to the housing and a second end connected to the other of the door or door frame, the arm being movable between a neutral door position and first and second open door positions, the first and second open door positions up to 180 degrees from the neutral position in opposite directions;

opposing first and second racks movable relative to each other and relative to the housing, the first and second racks each having a first end adapted to engage a piston within the housing;

a pinion within the housing and pivotally connected to the arm first end, the pinion engaging teeth of the first and second racks;

a piston having a first end adapted to engage the first end of the first and second racks;

a spring-loaded locking mechanism, wherein the locking mechanism engages the piston and one of the first and second racks after movement of the arm from the neutral position to one of the first and second door open positions and disengages the piston from the one of the first and second racks when the arm returns to the neutral position; and a spring compressible by an opposite end of the piston, wherein movement of the arm from the neutral position to one of the first or second door open positions rotates the pinion and urges the first end of the first or second rack into engagement with the piston first end, the piston compressing the spring until the door reaches one of the first or second door open position, and wherein movement of the arm from the neutral position to the other of the first or second door open position rotates the pinion in an opposite direction and urges the first end of the other of the first or second rack into engagement with the piston first end, the piston compressing the spring until the door reaches the other of the first or second door open position.

2. The door closer of claim 1 wherein the locking mechanism comprises a projection extending from the piston first end and engaging a concavity in at least one of the first and second rack first ends.

3. The door closer of claim 1 wherein the spring is biased in partial compression when the arm is in the neutral position.

4. The door closer of claim 1 wherein the door closer further comprises a set of adjustment valves partially disposed within the housing for controlling fluid flow within the housing, wherein rate of fluid flow controls the movement of the piston.

5. The door closer of claim 4 wherein the set of adjustment valves face downward when the door closer is mounted to one of the door or door frame.

6. The door closer of claim 1 wherein when one of the first or second rack first ends engages the piston first end, the other of the first or second rack first ends is not engaged with the piston first end.

7. The door closer of claim 1 wherein each of the first and second racks are extended in length to allow for the rack and pinion to travel in opposite directions when rotated by movement of the arm between the neutral position and one of the first or second door open positions.

8. A method of controlling a door, comprising:

providing a door operable between a neutral position and first and second open positions, the first and second open positions up to 180 degrees from the neutral position in opposite directions;

providing a door closer comprising:

a housing mountable to one of a door or a door frame;

an arm having a first end pivotally attached to the housing and a second end connected to the other of the door or door frame, the arm being movable between the neutral door position and the first and second open door positions;

opposing first and second racks movable relative to each other and relative to the housing, the first and second racks each having a first end adapted to engage a piston within the housing;

a pinion within the housing and pivotally connected to the arm first end, the pinion engaging teeth of the first and second racks;

a piston having a first end adapted to engage the first end of the first and second racks;

a spring-loaded locking mechanism adapted to engage the piston and the first and second racks; and a spring compressible by an opposite end of the piston;

initiating movement of the arm from the neutral position to one of the first or second door open positions to rotate the pinion and urge the first end of the first or second rack into engagement with the piston first end, the piston compressing the spring until the door reaches one of the first or second door open position;

engaging the piston and one of the first and second racks by the locking mechanism after movement of the arm from the neutral position to one of the first and second door open positions;

returning the arm to the neutral position as a result of the spring urging the piston in an opposite direction against the first or second rack and rotating the pinion in an opposite direction until the spring reaches its initial position; and disengaging the piston from the one of the first and second racks when the arm returns to the neutral position.

9. The method of claim 8 wherein the locking mechanism comprises a projection extending from the piston first end and engaging a concavity in at least one of the first and second rack first ends.

10. The method of claim 8 wherein the spring is biased in partial compression when the arm is in the neutral position.

11. The method of claim 8 wherein the door closer further comprises a set of adjustment valves partially disposed within the housing for controlling fluid flow within the housing, wherein rate of fluid flow controls the movement of the piston, and further including the step of adjusting one or more valves corresponding to operating parameters of the door.

12. The method of claim 11 wherein the set of adjustment valves face downward when the door closer is mounted to one of the door or door frame.

13. The method of claim 8 wherein when one of the first or second rack first ends engages the piston first end, the other of the first or second rack first ends is not engaged with the piston first end.

14. The method of claim 8 wherein each of the first and second racks are extended in length to allow for the rack and pinion to travel in opposite directions when rotated by movement of the arm between the neutral position and one of the first or second door open positions.

15. A method of making a door closer, comprising:

providing a housing mountable to one of a door or a door frame;

providing an arm having a first end pivotally attached to the housing and a second end connected to the other of the door or door frame, the arm being movable between a neutral door position and first and second open door positions, the first and second open door positions up to 180 degrees from the neutral position in opposite directions;

providing opposing first and second racks movable relative to each other and relative to the housing, the first and second racks each having a first end adapted to engage a piston within the housing;

providing a pinion within the housing and pivotally connected to the arm first end, the pinion engaging teeth of the first and second racks;

providing a piston having a first end adapted to engage the first end of the first and second racks;

providing a spring-loaded locking mechanism, wherein the locking mechanism engages the piston and one of the first and second racks after movement of the arm from the neutral position to one of the first and second door open positions and disengages the piston from the one of the first and second racks when the arm returns to the neutral position; and providing a spring compressible by an opposite end of the piston, wherein movement of the arm from the neutral position to one of the first or second door open positions rotates the pinion and urges the first end of the first or second rack into engagement with the piston first end, the piston compressing the spring until the door reaches one of the first or second door open position, and wherein movement of the arm from the neutral position to the other of the first or second door open position rotates the pinion in an opposite direction and urges the first end of the other of the first or second rack into engagement with the piston first end, the piston compressing the spring until the door reaches the other of the first or second door open position.

16. The method of claim 15 wherein the locking mechanism comprises a projection extending from the piston first end and engaging a concavity in at least one of the first and second rack first ends.

17. The method of claim 15 wherein the spring is biased in partial compression when the arm is in the neutral position.

18. The method of claim 15 further comprising:

providing a set of adjustment valves partially disposed within the housing for controlling fluid flow within the housing, wherein rate of fluid flow controls the movement of the piston.

19. The method of claim 18 wherein the set of adjustment valves face downward when the door closer is mounted to one of the door or door frame.

20. The method of claim 15 wherein when one of the first or second rack first ends engages the piston first end, the other of the first or second rack first ends is not engaged with the piston first end.

21. The method of claim 15 wherein each of the first and second racks are extended in length to allow for the rack and pinion to travel in opposite directions when rotated by movement of the arm between the neutral position and one of the first or second door open positions.

* * * * *